US005970760A

United States Patent [19]

Shen

[11] Patent Number: 5,970,760

[45] Date of Patent: Oct. 26, 1999

[54] LOCK CORE-CHANGEABLE TYPE AUXILIARY LOCK WITH IMPROVED PULL-RESISTANT STRUCTURE

[76] Inventor: Mu-Lin Shen, No. 32, La. 76, Fu-An Rd.., Sec. 5, Tainan, Taiwan

[21] Appl. No.: 09/228,344

[22] Filed: Jan. 11, 1999

[51] Int. Cl.[6] ..... E05B 9/04

[52] U.S. Cl. ..... 70/371; 70/369

[58] Field of Search ..... 70/371, 370, 375, 70/367, 369, 368, 372–374

[56] References Cited

U.S. PATENT DOCUMENTS

| | | | |
|---|---|---|---|
| 3,713,311 | 1/1973 | Oliver et al. | 70/369 |
| 4,444,034 | 4/1984 | Best et al. | 70/371 X |
| 4,953,373 | 9/1990 | Toledano | 70/369 |
| 5,121,619 | 6/1992 | Martin | 70/371 |
| 5,713,231 | 2/1998 | Shen | 70/370 |
| 5,873,272 | 2/1999 | Thompson | 70/371 X |

FOREIGN PATENT DOCUMENTS

| | | | |
|---|---|---|---|
| 1808633 | 6/1970 | Germany | 70/371 |
| 2723887 | 12/1978 | Germany | 70/369 |
| 35783 | 9/1922 | Norway | 70/371 |
| 537277 | 6/1941 | United Kingdom | 70/369 |
| 555550 | 8/1943 | United Kingdom | 70/369 |

*Primary Examiner*—Suzanne Dino Barrett
*Attorney, Agent, or Firm*—Alan Kamrath; Oppenheimer Wolff & Donnelly LLP

[57] ABSTRACT

An auxiliary lock includes a housing, a positioning seat securely mounted in the housing, a lock core housing securely mounted in the positioning seat and including a compartment, and a lock core removably mounted in the compartment of the lock core housing. The lock core includes two lateral sides each having a recessed section. A core lug is received in one of the recessed sections. The core lug is movable by rotation of a key for changing lock cores. The lock core housing further includes two cutout sections respectively defined in two lateral sides thereof. One of the cutout sections includes a slot communicated with the compartment of the lock core housing. A lateral inner wall that defines a portion of the compartment of the lock core housing includes a protruded edge. A lug retainer is mounted in the cutout section having the slot. The lug retainer includes a first end retained in the cutout section having the slot. The lug retainer further includes a second end extended into the compartment of the lock core housing for releasably engaging with a groove of the core lug. When the lock core is at a position for locking/unlocking operation, the core lug of the lock core bears against the protruded edge of the lock core housing, while the lug retainer is received in the groove of the core lug to prevent from forcible outward movement of the lock core by axial pull.

2 Claims, 6 Drawing Sheets

LOCK CORE-CHANGEABLE TYPE AUXILIARY LOCK WITH IMPROVED PULL-RESISTANT STRUCTURE

BACKGROUND OF THE INVENTION

1. Field of the Invention

The present invention relates to an auxiliary lock of the type having an interchangeable lock core with improved pull-resistant structure to prevent the lock core from being forcibly pulled outwards.

2. Description of the Related Art

Auxiliary locks provide additional protection to property and life. Auxiliary locks generally includes three types, i.e., "blank plate type" in which the auxiliary lock can be locked or unlocked by a key from outside only, "single cylinder type" in which the auxiliary lock can be locked or unlocked by a key from outside and by a thumbturn on the inside, and "double cylinder type" in which the auxiliary lock can be locked or unlocked by a key from either side.

FIG. 5 of the drawings illustrates a conventional auxiliary lock 60 of single cylinder type. A lock core housing 70 is mounted in a positioning seat 62, which, in turn, is mounted in a housing 61. Removably mounted in a figure "8" compartment 71 of the lock core housing 70 is a lock core 80 that is also substantially "8" shaped. As shown in FIG. 6, the lock core 80 includes a recessed section 81 in each of two lateral sides thereof, wherein one of the recessed sections 81 has a core lug 82 movably received therein. A lateral inner wall that defines a portion of the figure "8" compartment 71 of the lock core housing 70 includes a protruded edge 72. When the lock core 80 is inserted into the compartment 71 and the key for changing lock cores is rotated through a pre-determined angle to a position for locking/unlocking, the core lug 82 is extended outward into a space 73 behind the protruded edge 72. Thus, the lock core 80 is not removable after the key for changing lock cores is removed.

Still referring to FIG. 5, when mounted to a door 90, a tail piece 75 is connected to a thumbturn 77 located inside. In addition, the tail piece 75 is connected to an end of the lock core 80. Accordingly, the user may lock or unlock the auxiliary lock 60 by a key from outside or by the thumbturn 77 from inside.

Theoretically, when the core lug 82 of the lock core 80 is located in the space 73 behind the protruded edge 72, the lock core 80 cannot be removed unless the key for changing the lock core is inserted into a keyway 83 of the lock core 80 and rotated through a pre-determined angle, as the core lug 82 will be stopped by the protruded edge 72 if the lock core 80 is pulled longitudinally outwards. In practice, an unauthorized person still may forcibly remove the lock core 80, destroy the auxiliary lock 60, and thus open the door 90. It is found that the lock core 80 is merely retained in place by means of the core lug 82 stopped by the protruded edge 72 that has a relatively small area. An unauthorized person may drill a screw hole in the front face of the lock core 80 and then insert a T-bolt into the screw hole. Then, the unauthorized person may apply a relatively large force to pull the T-bolt outwards and thus destroy the protruded edge 72 by the core lug 82. As a result, the auxiliary lock 60 is damaged and the door 90 is no longer locked. In brief, the auxiliary locks of the type having an interchangeable lock core can be easily disabled, as the retaining effect of the core lug 82 is not enough. The present invention is intended to provide an auxiliary lock that mitigates and/or obviates this problem.

SUMMARY OF THE INVENTION

It is a primary object of the present invention to provide an auxiliary lock of the type having an interchangeable lock core with improved pull-resistant structure to prevent the lock core from being forcibly pulled outwards, thereby providing a burglar-proof effect.

An auxiliary lock in accordance with the present invention comprises a housing, a positioning seat securely mounted in the housing, a lock core housing securely mounted in the positioning seat and including a compartment, and a lock core removably mounted in the compartment of the lock core housing. The lock core includes two lateral sides each having a recessed section. A core lug is movably received in one of the recessed sections and includes a groove defined therein. The lock core housing further includes two cutout sections respectively defined in two lateral sides thereof. One of the cutout sections includes a slot communicated with the compartment of the lock core housing. A lateral inner wall that defines a portion of the compartment of the lock core housing includes a protruded edge. A lug retainer is mounted in the cutout section having the slot. The lug retainer includes a first end retained in the cutout section having the slot. The lug retainer further includes a second end extended into the compartment of the lock core housing for releasably engaging with the groove of the core lug.

When the lock core is at a position for locking/unlocking operation, the core lug of the lock core bears against the protruded edge of the lock core housing, while the lug retainer is received in the groove of the core lug to prevent from forcible outward movement of the lock core by axial pull.

The first end of the lug retainer may include an arcuate section for engaging with a portion of an outer periphery of a bolt for mounting the auxiliary lock.

The second end of the lug retainer may include two arcuate surfaces and a tip between the arcuate surfaces to guide the lug retainer into the groove of the core lug.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
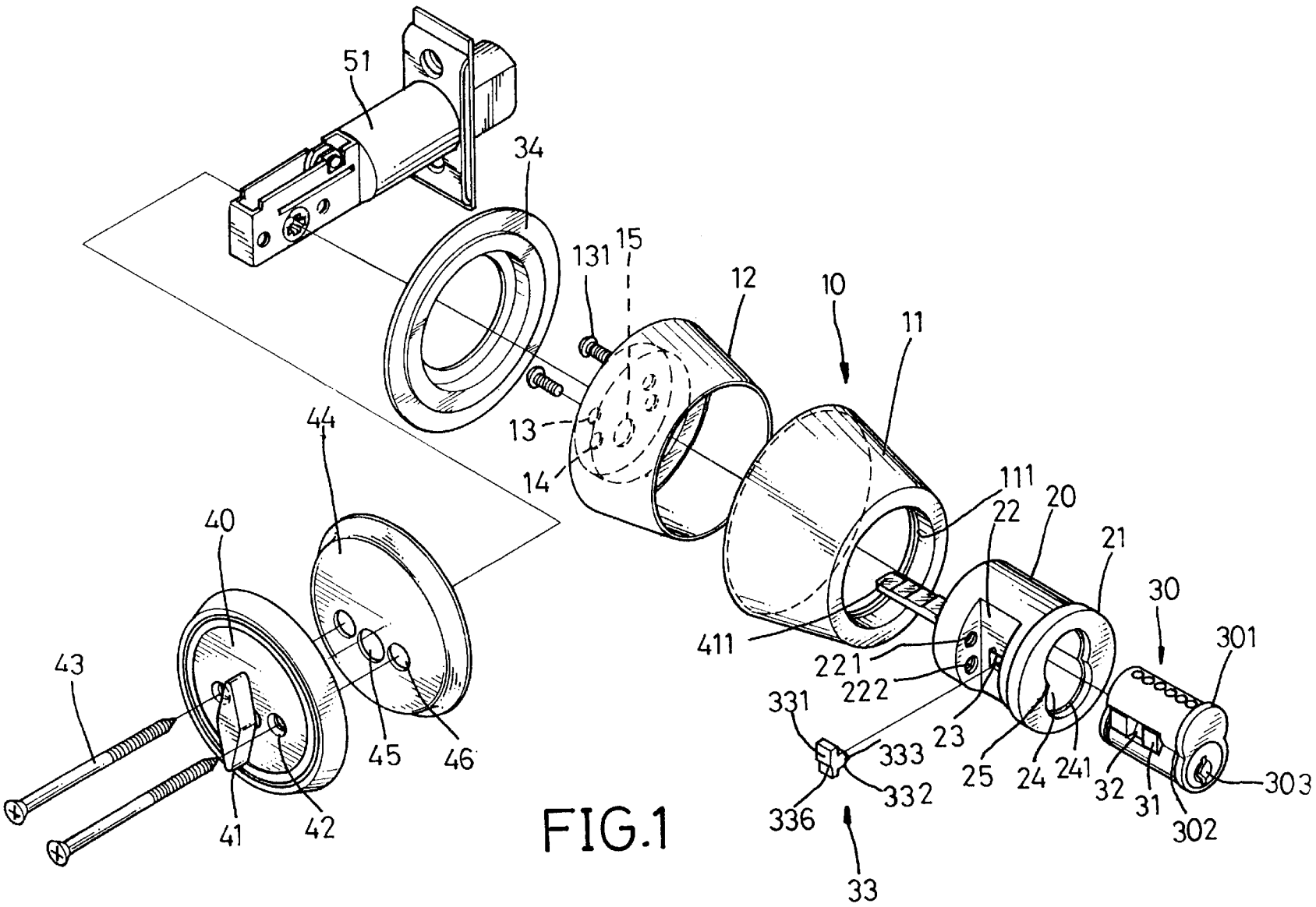
FIG. 1 is an exploded perspective view of an auxiliary lock in accordance with the present invention.
Figure 2:
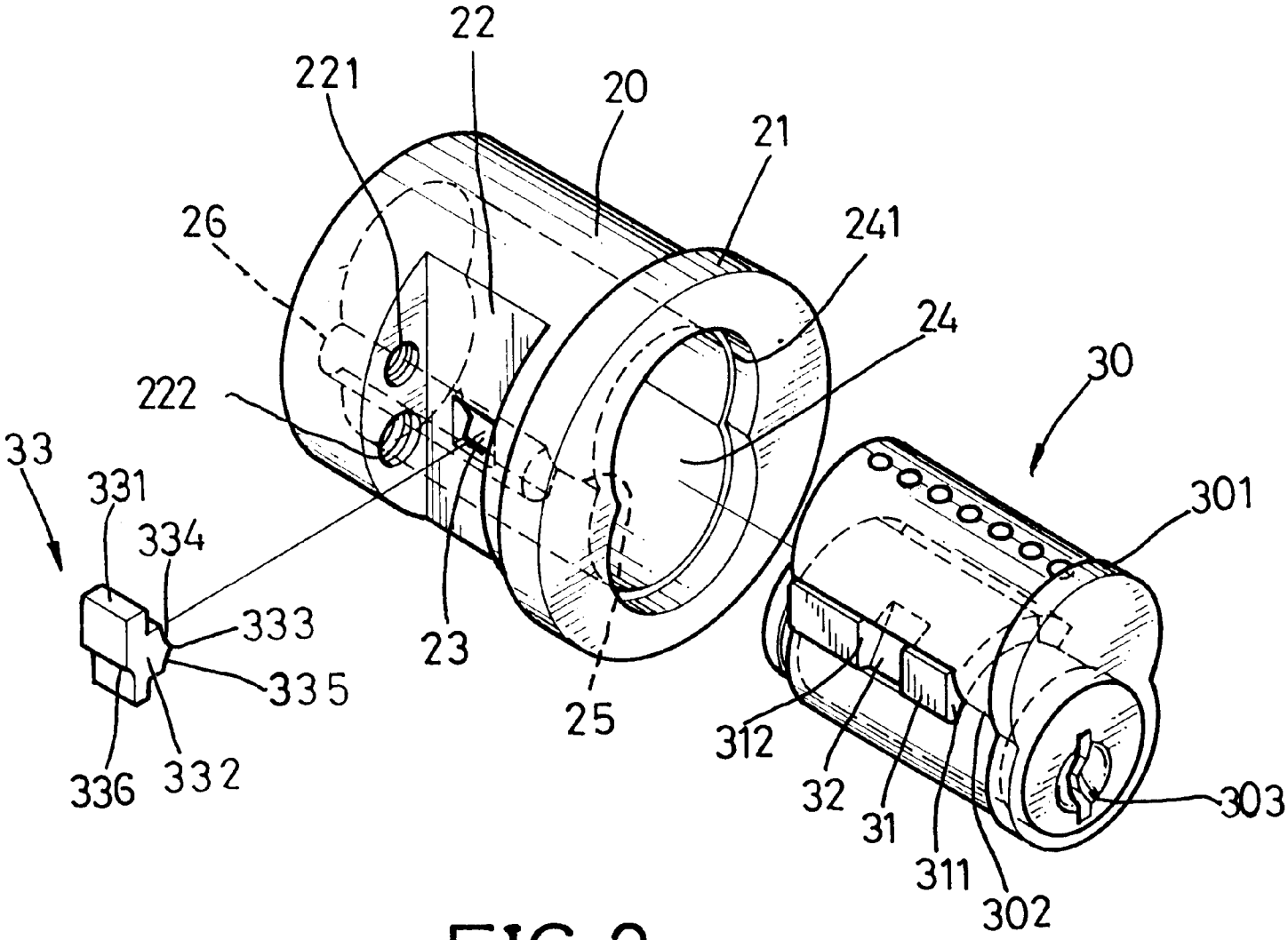
FIG. 2 is an enlarged exploded perspective view of a lock core housing and a lock core of the auxiliary lock in accordance with the present invention.
Figure 3:
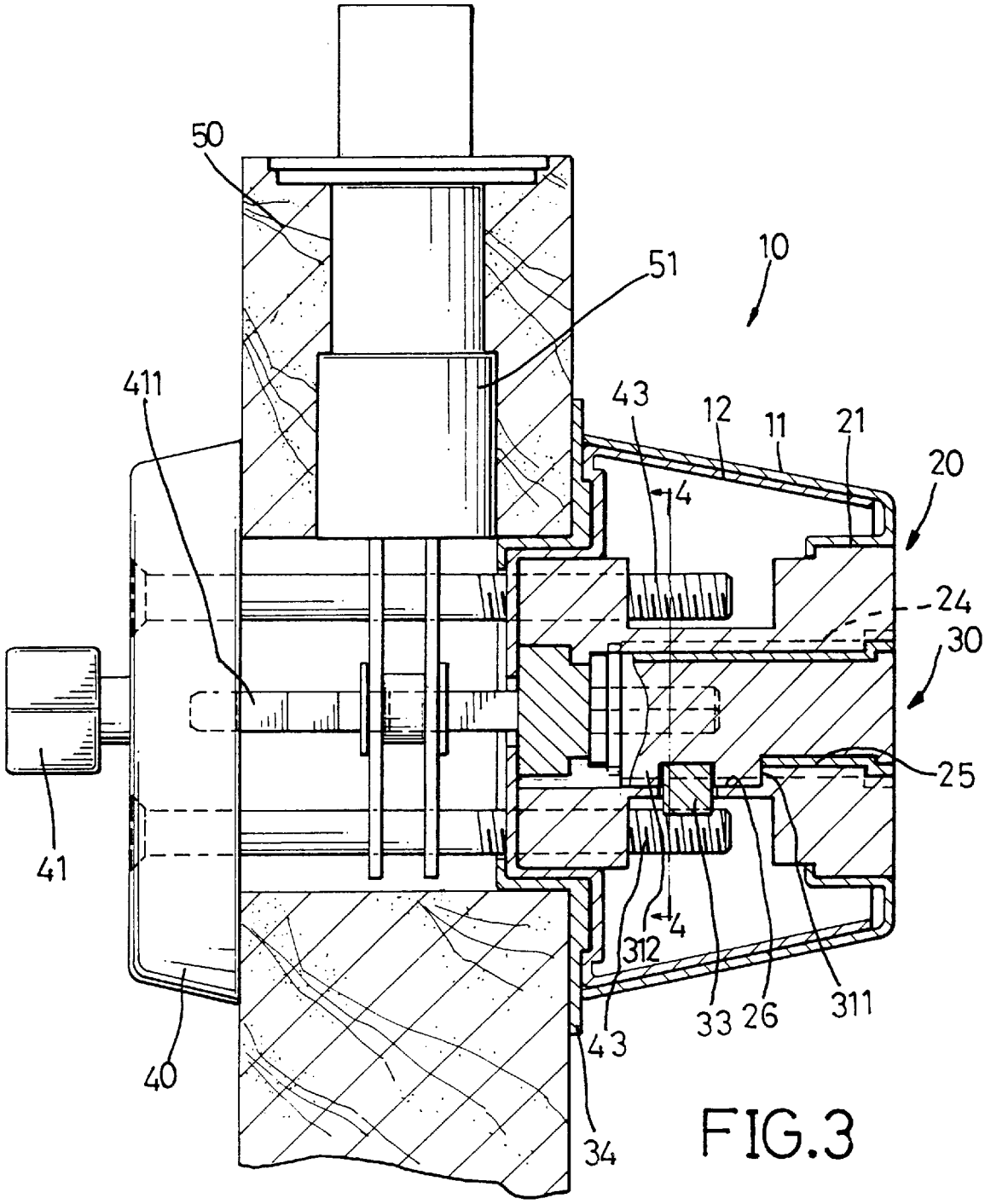
FIG. 3 is a sectional view of the auxiliary lock in accordance with the present invention and a door.

Referring to the drawings and initially to FIGS. 1 and 2, an auxiliary lock 10 in accordance with the present invention generally includes an outer assembly, an inner assembly, and a deadbolt 51 (FIG. 3). The inner assembly comprises a housing 11, a positioning seat 12 mounted in the housing 11, a lock core housing 20 mounted in the positioning seat 12, and a lock core 30 removably mounted in the lock core housing 20. The inner assembly comprises a rose liner 44, an outside rose 40, and a thumbturn 41.

The positioning seat 12 includes an end wall having two upper positioning holes 13, two lower positioning holes 14, and a through-hole 15 defined therein. The lock core housing 20 includes an enlarged end face 21 that bears against a shoulder 111 formed on a front end of the housing 11 for the lock core housing 20 to stay. The lock core housing 20 further includes a figure "8" compartment 24 defined therein. The enlarged end face 21 of the lock core 20 includes a shoulder 241 that is formed adjacent to a front end of the compartment 24. A lateral inner wall that defines a portion of the figure "8" compartment 24 of the lock core housing 20 includes a protruded edge 25. The lock core housing 20 further includes two cutout sections 22 respectively defined in two lateral sides thereof. One of the cutout sections 22 includes a slot 23 communicated with the compartment 24. An end wall that defines a portion of each cutout section 22 includes two screw holes 221 and 222 that will be described later.

The lock core 30 is substantially "8" shaped and includes a front end 301 having a keyway 303 defined therein. The front end 301 of the lock core 30 is stopped by the shoulder 241 of the lock core housing 20 when the lock core 30 is inserted into the lock core housing 20. Each of two lateral sides of the lock core 30 includes a recessed section 302, wherein one of the recessed sections 302 has a core lug 31 movably received therein. The core lug 31 includes a groove 32 defined therein. The core lug 31 is rotatable through an angle upon rotation of a key for changing lock cores.

When mounting the auxiliary lock 10 to a door 50, referring to FIGS. 1 and 3, the lock core 30 is mounted into the lock core housing 20, which is then mounted into the housing 11. The positioning seat 12 is inserted into the housing 11 via a rear end of the latter, and screws 131 are extended through the holes 131 and the screw holes 221 of the lock core housing 20. A reinforcing ring 34 may be mounted between an outer side of the door 50 and the positioning seat 12. Two bolts 43 are extended through the deadbolt 51 to mount the inner assembly and the inner assembly to the door 50. Each bolt 43 is extended through an associated hole 42 in the outside rose 40, an associated hole 46 in the rose liner 44, an associated hole 14 in the positioning seat 12, and a screw hole 222 in the lock core housing 20. The thumbturn 41 is rotatably mounted to the outside rose 40 and is connected to a tail piece 411 that has an end securely engaged with the thumbturn 41 to rotate therewith. The tail piece 411 extends through an associated hole 45 in the rose liner 44 and the hole 15 of the positioning seat 12 such that the other end of the tail piece 411 is engaged with the other end of the lock core 30 to rotate therewith. The tail piece 411 also extends through a deadbolt cross hole (not shown) of the deadbolt 51. Thus, the deadbolt 51 can be locked or unlocked by a key for locking/unlocking from outside and by the thumbturn 41 from inside, thereby locking or unlocking the door 50, which is conventional and therefore not further described.

The auxiliary lock 10 in accordance with the present invention further includes a lug retainer 33 that is located in the cutout section 22 with the slot 23 and is partially extended through the slot 23 so as to be received in the groove 32 of the core lug 31. This allows an additional retaining effect for the lock core 30. Thus, destruction of the auxiliary lock by forcibly pulling the lock core encountered by the conventional auxiliary locks is avoided.

As shown in FIG. 2, in a preferred embodiment of the invention, the lug retainer 33 includes a base 331 and a main body 332 projecting from the base 331. The main body 332 includes a distal end with two arcuate surface 334 and 335 and a tip 333. This may guide the distal end of the main body 332 into the groove 32 to achieve the required retaining function. Still referring to FIG. 2, the core lug 31 includes a rear lug face 312 that faces the groove 32 and a front lug face 311 that faces the enlarged end face 301. The two faces 311 and 312 securely retain the lock core 30 in place. The base 331 includes an arcuate section 336 that engages with a portion of an outer periphery of a bolt 43 that extends through the screw hole 222 (FIG. 3). This may reliably bias the lug retainer 33 into the space 26 for engaging with the groove 32 of the core lug 31.

Figure 4:
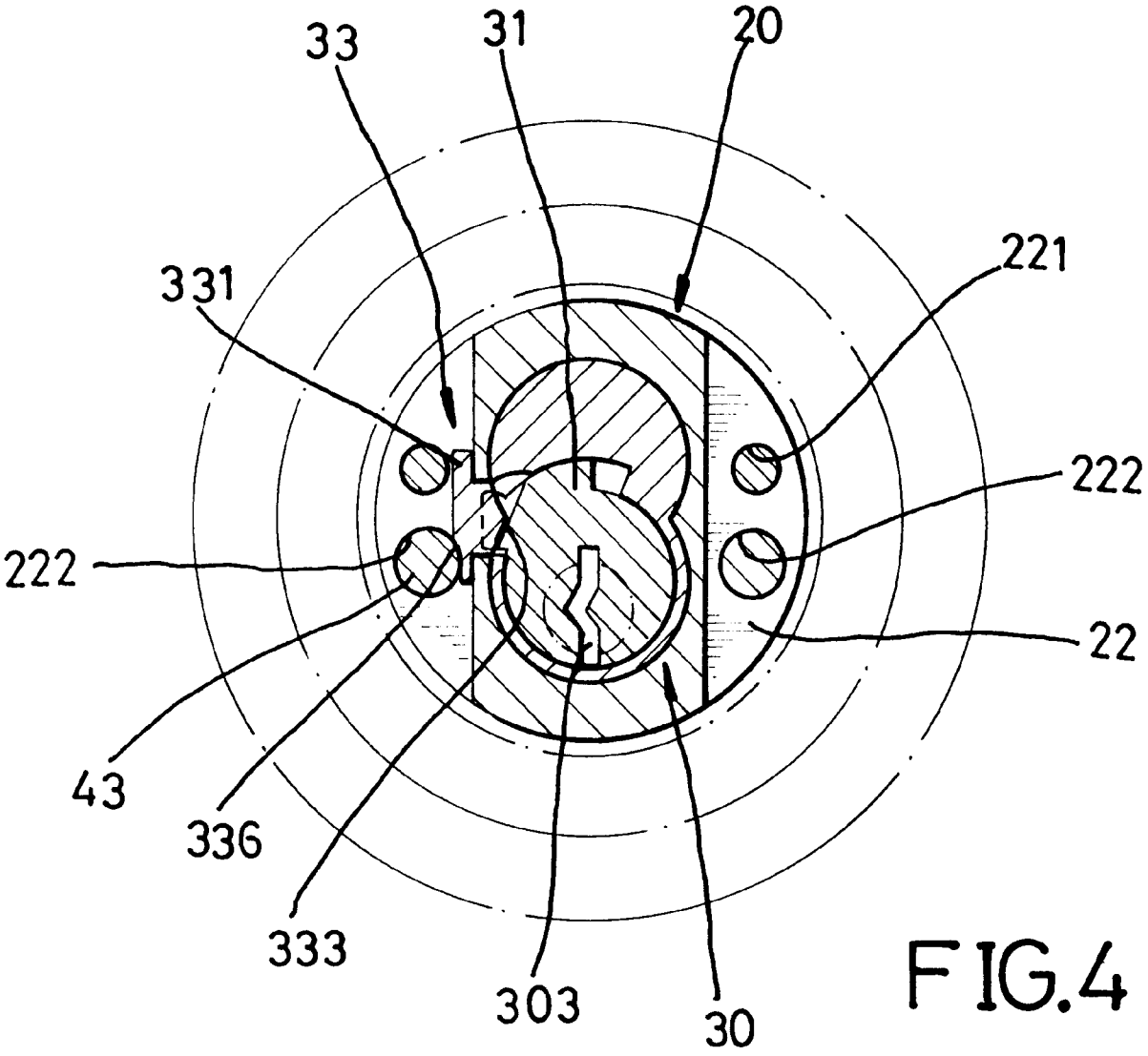
FIG. 4 is a sectional view taken along line 4—4 in FIG. 3.
Figure 5:
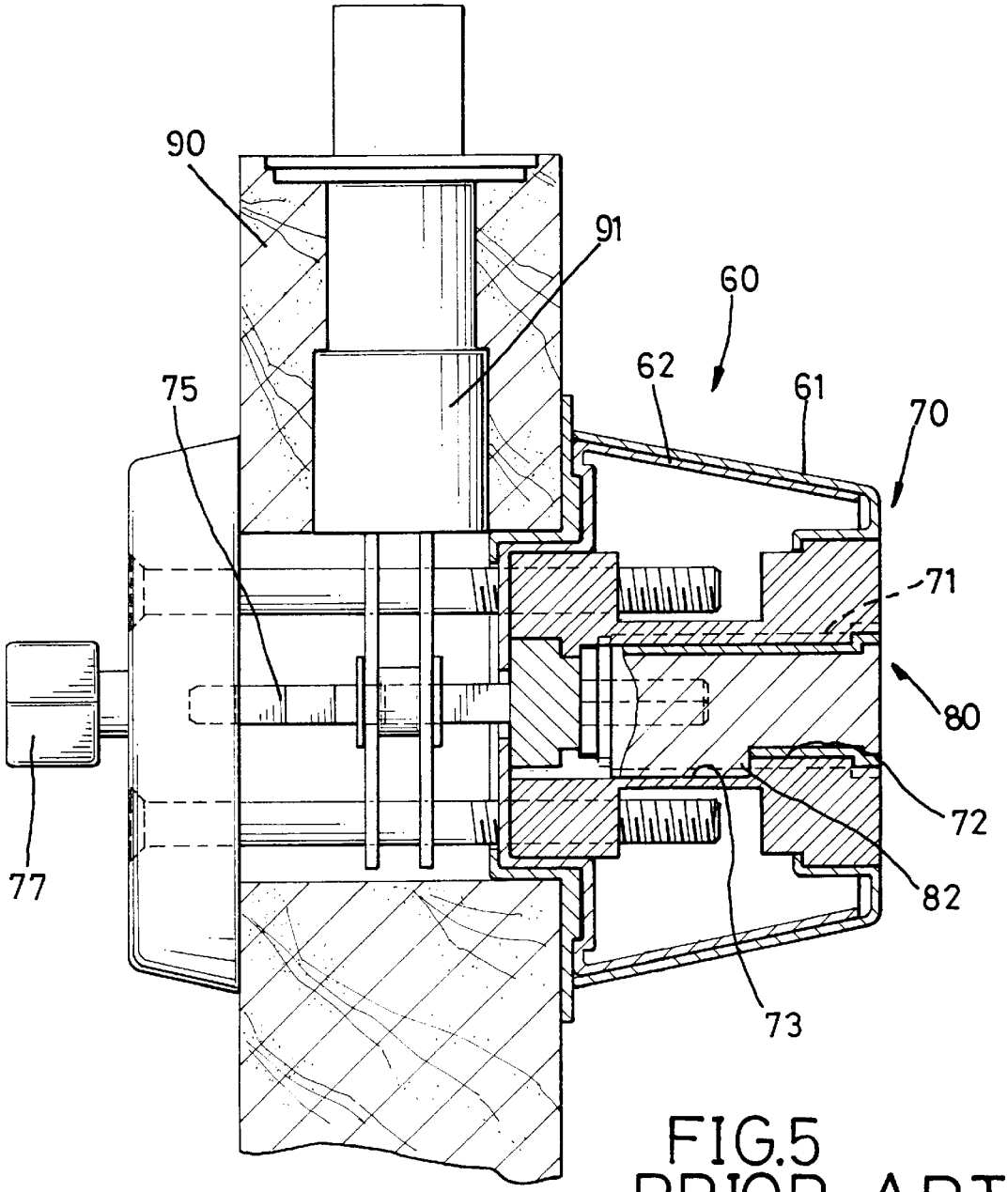
FIG.5 PRIOR ART
FIG. 5 is a sectional view of a conventional auxiliary lock and a door.
Figure 6:
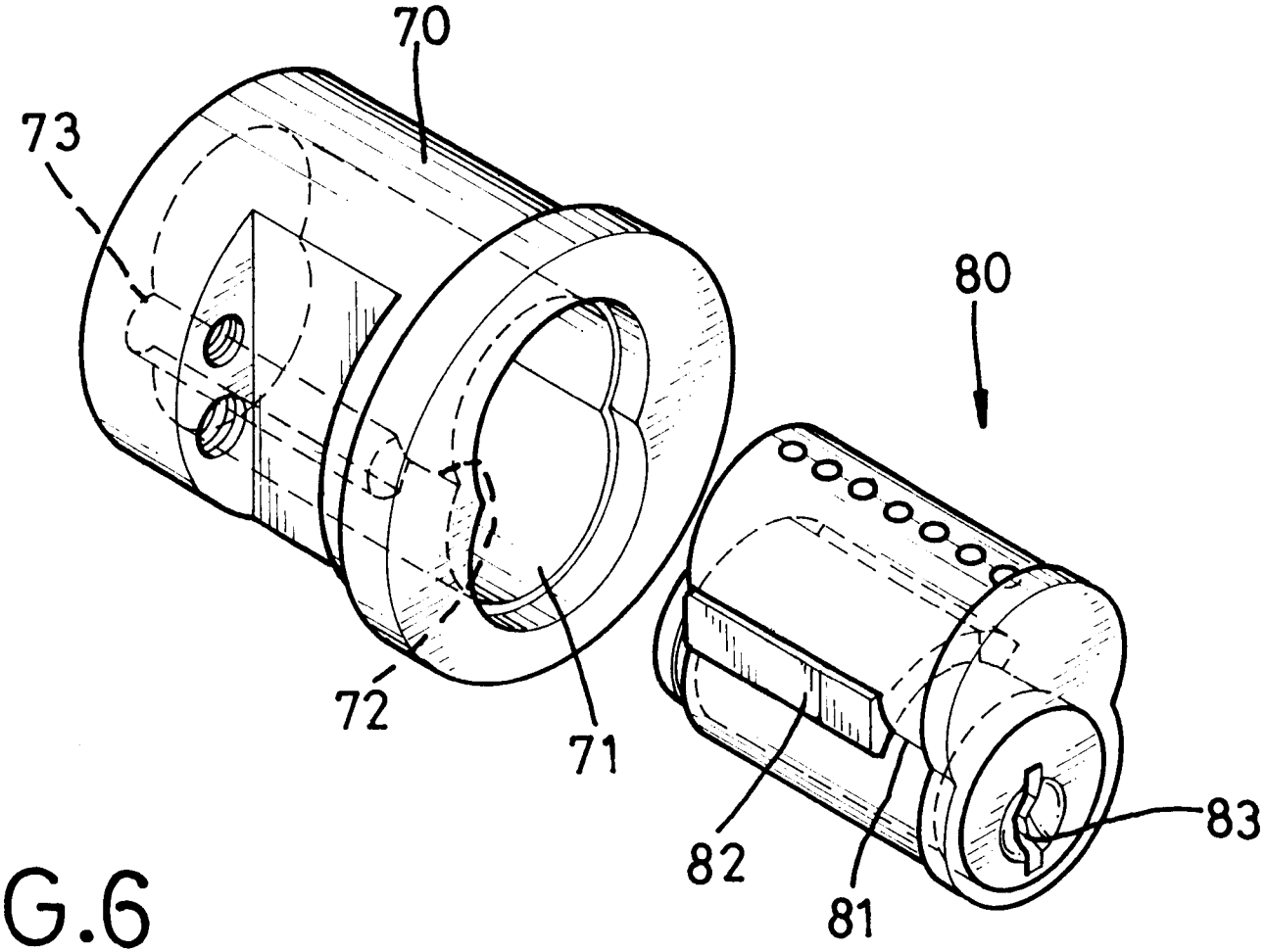
FIG.6 PRIOR ART
FIG. 6 is an exploded perspective view of a lock core housing and a lock core of the conventional auxiliary lock.

Referring to FIGS. 3 and 4, when the lock core 30 is inserted into the compartment 24 and the key for changing lock cores is rotated through a pre-determined angle to a position for locking/unlocking operation, the core lug 31 of the lock core 30 is moved into the space 26 behind the protruded edge portion 25. In addition, the lug retainer 33 is received in the groove 32 of the core lug 31. Thus, the lock core 30 is not removable after the key for changing lock cores is removed. Even if the lock core 30 is forcibly pulled outwards, such action will not success as the lock core 30 will be stopped by the lug retainer 33 and the protruded edge 25 of the lock core housing 20. Accordingly, a stronger structure resistant to pulling is provided for auxiliary locks of the type having an interchangeable lock core.

Although the invention has been explained in relation to its preferred embodiment, it is to be understood that many other possible modifications and variations can be made without departing from the spirit and scope of the invention as hereinafter claimed.

What is claimed is:

1. An auxiliary lock comprising a housing, a positioning seat securely mounted in the housing, a lock core housing securely mounted in the positioning seat and including a compartment, and a lock core removably mounted in the compartment of the lock core housing, the lock core including two lateral sides each having a recessed section, a core lug being removably received in one of the recessed sections, the core lug including a groove defined therein, the lock core housing further including two cutout sections respectively defined in two lateral sides thereof, one of the cutout sections including a slot communicated with the compartment of the lock core housing, a lateral inner wall that defines a portion of the compartment of the lock core housing including a protruded edge, and further including a lug retainer mounted in the cutout section having the slot, the lug retainer including a first end retained in the cutout section having the slot, the first end of the lug retainer including an arcuate section the lug retainer further including a second end extended through the slot into the compartment of the lock core housing for releasably engaging with the groove of the core lug, wherein when the lock core is at a position for locking/unlocking operation, the core lug bears against the protruded edge, while the lug retainer is received in the groove of the core lug.

2. An auxiliary lock comprising a housing, a positioning seat securely mounted in the housing, a lock core housing securely mounted in the positioning seat and including a compartment, and a lock core removably mounted in the compartment of the lock core housing, the lock core including two lateral sides each having a recessed section, a core lug being removably received in one of the recessed sections, the core lug including a groove defined therein, the lock core housing further including two cutout sections respectively defined in two lateral sides thereof, one of the cutout sections including a slot communicated with the compartment of the lock core housing, a lateral inner wall that defines a portion of the compartment of the lock core housing including a protruded edge, and further including a lug retainer mounted in the cutout section having the slot, the lug retainer including a first end retained in the cutout section having the slot, the lug retainer further including a second end extended through the slot into the compartment of the lock core housing for releasably engaging with the groove of the core lug, wherein the second end of the lug retainer includes two arcuate surfaces and a tip between the arcuate surfaces, wherein when the lock core is at a position for locking/unlocking operation, the core lug bears against the protruded edge, while the lug retainer is received in the groove of the core lug.

* * * * *